US007513187B1

(12) United States Patent
Lambermont

(10) Patent No.: US 7,513,187 B1
(45) Date of Patent: Apr. 7, 2009

(54) GUN MOUNT

(75) Inventor: Shawn P. Lambermont, Jasonville, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 12/076,354

(22) Filed: Mar. 17, 2008

Related U.S. Application Data

(63) Continuation of application No. 11/254,123, filed on Oct. 19, 2005, now abandoned.

(51) Int. Cl.
*F41A 27/14* (2006.01)

(52) U.S. Cl. ..... 89/37.07; 89/37.02; 89/37.03

(58) Field of Classification Search ..... 89/37.02, 89/37.03, 37.04, 37.07
See application file for complete search history.

(56) References Cited

U.S. PATENT DOCUMENTS

| | | | | |
|---|---|---|---|---|
| 2,014,791 | A * | 9/1935 | Trimbach | 89/37.03 |
| 2,309,808 | A * | 2/1943 | Trotter | 89/37.03 |
| 2,391,956 | A * | 1/1946 | Eastman | 188/110 |
| 3,999,461 | A | 12/1976 | Johnson et al. | |
| 4,393,614 | A | 7/1983 | Pickett | |
| 5,127,309 | A | 7/1992 | Menges et al. | |
| 5,159,147 | A | 10/1992 | Menges et al. | |

* cited by examiner

*Primary Examiner*—Stephen M Johnson
(74) *Attorney, Agent, or Firm*—John G. Mills, III; Mark O. Glut; U.S. Navy-NAVAIR Naval Air Systems Command

(57) ABSTRACT

A gun mount which includes a cradle for holding at least two weapons, a carriage for holding the cradle such that the cradle may pivot left and right, and depress and elevate, at least two ammunition trays able to supply ammunition to the at least two weapons, a pintle, and a link deflector. The pintle is attached to the carriage and attachable to a gun stand. The link deflector deflects discharged ammunition links downward as the ammunition links come out of the weapons.

1 Claim, 9 Drawing Sheets

GUN MOUNT

This application is a continuation application of U.S. patent application Ser. No. 11/254,123 now abandoned, filed on Oct. 19, 2005 and claims domestic priority with regard to that application under 35 U.S.C. 120.

The invention described herein may be manufactured and used by or for the Government of the United States of America for governmental purposes without payment of any royalties thereon or therefor.

BACKGROUND

The present invention relates to a gun mount. More specifically, but without limitation, the present invention relates to a multiple M240 machine gun mount.

Currently there are no multiple M240 machine gun mounts that can be utilized in a single firing position. In today's dangerous environment, additional firepower and ammunition capacity is required, especially from a river craft or air or land vehicle.

Thus, there is a need in the art to provide a gun mount without the limitations inherent in present methods.

SUMMARY

The present invention is directed to a gun mount. The gun mount includes a cradle for holding at least two weapons or guns, a carriage for holding the cradle such that the cradle may pivot left and right, and depress and elevate, at least two ammunition trays able to supply ammunition to the at least two weapons, a pintle, and a link deflector. The pintle is attached to the carriage and attachable to a gun stand. The link deflector deflects discharged ammunition links downward as they come out of the weapon.

It is a feature of the invention to provide a gun mount that allows at least two weapons to be mounted in a single firing position.

It is a feature of the invention to provide a gun mount that can hold multiple weapons or guns, specifically multiple M240 machine guns.

BRIEF DESCRIPTION OF THE DRAWINGS

These and other features, aspects and advantages of the present invention will become better understood with reference to the following description and appended claims, and accompanying drawings wherein:

DETAILED DESCRIPTION

Figure 1:
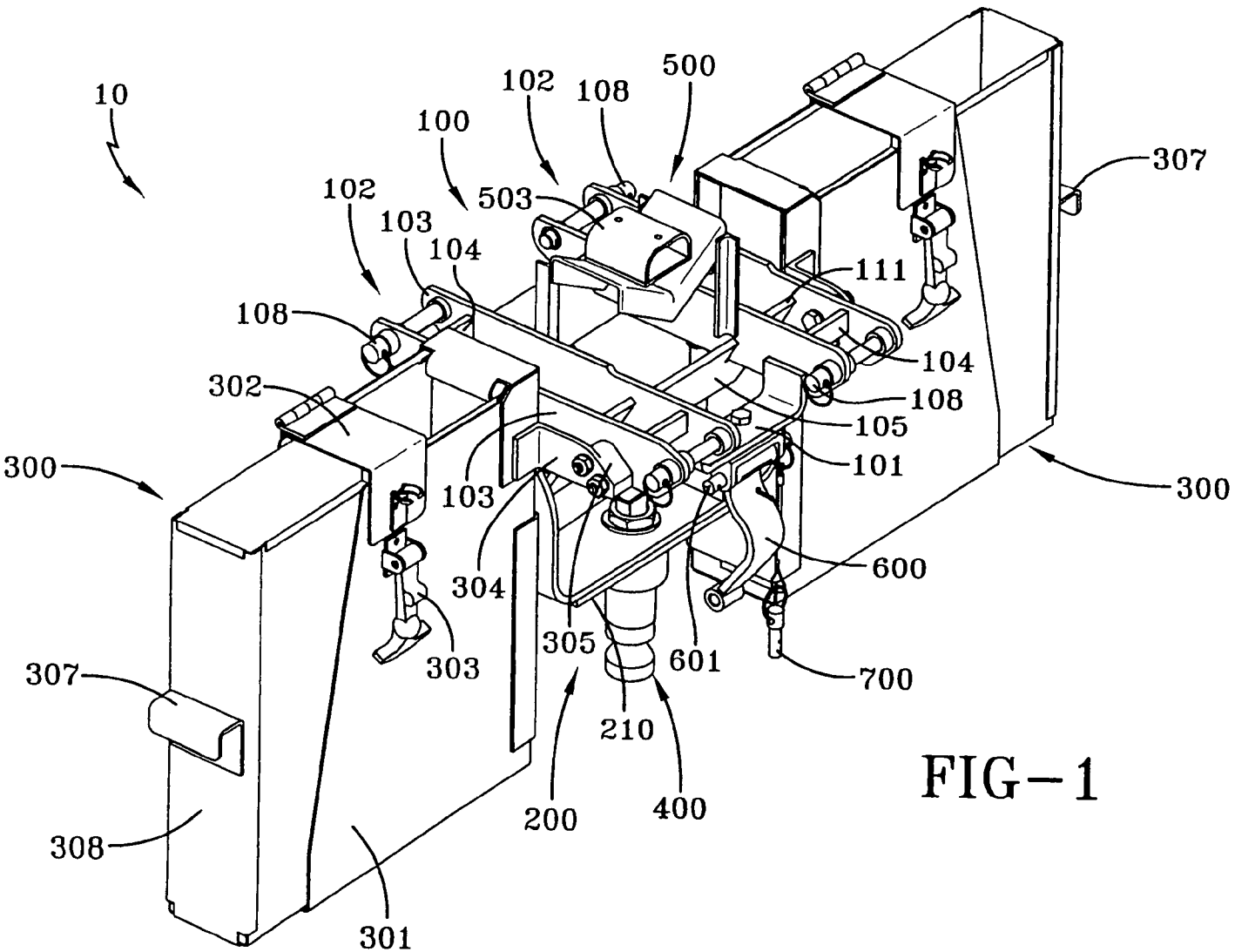
FIG. 1 is a perspective view of an embodiment of the gun mount.
Figure 2A:
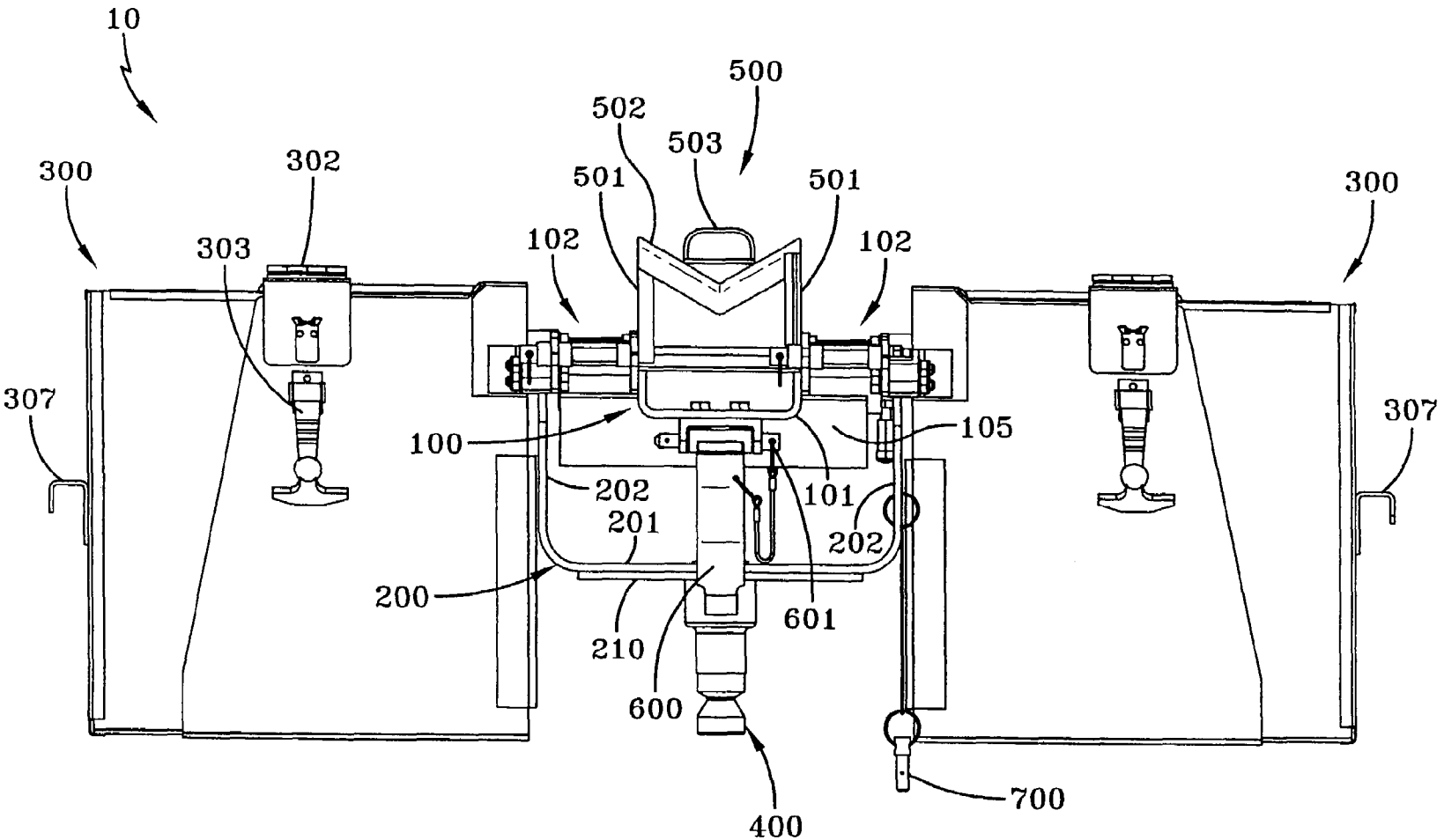
FIG. 2A is a front view of an embodiment of the gun mount.

The preferred embodiments of the present invention are illustrated by way of example below and in the above listed figures. As seen in FIGS. 1 and 2A, a gun mount 10 includes a cradle 100 for holding at least two machine guns, a carriage 200 for holding the cradle 100, at least two ammunition trays 300, a pintle 400, and a link deflector 500 for deflecting discharged ammunition links downward as the ammunition links come out of the machine guns. The carriage 200 holds the cradle 100 such that the cradle 100 may pivot left and right, and depress and elevate. The at least two ammunition trays 300 are able to supply ammunition to the at least two machine guns. The pintle 400 is attached to the carriage 200, and the pintle 400 is attachable to a gun stand. The gun stand may be attachable to a boat, ship, helicopter, aircraft, land vehicle or any type of platform. However, the gun stand may be self supporting and not attached to any type of platform.

In the discussion of the present invention, the invention will be discussed in a weapon environment especially in a M240 machine gun environment; however, this invention can be utilized for any type of need that requires use of a mounting system.

Figure 2B:
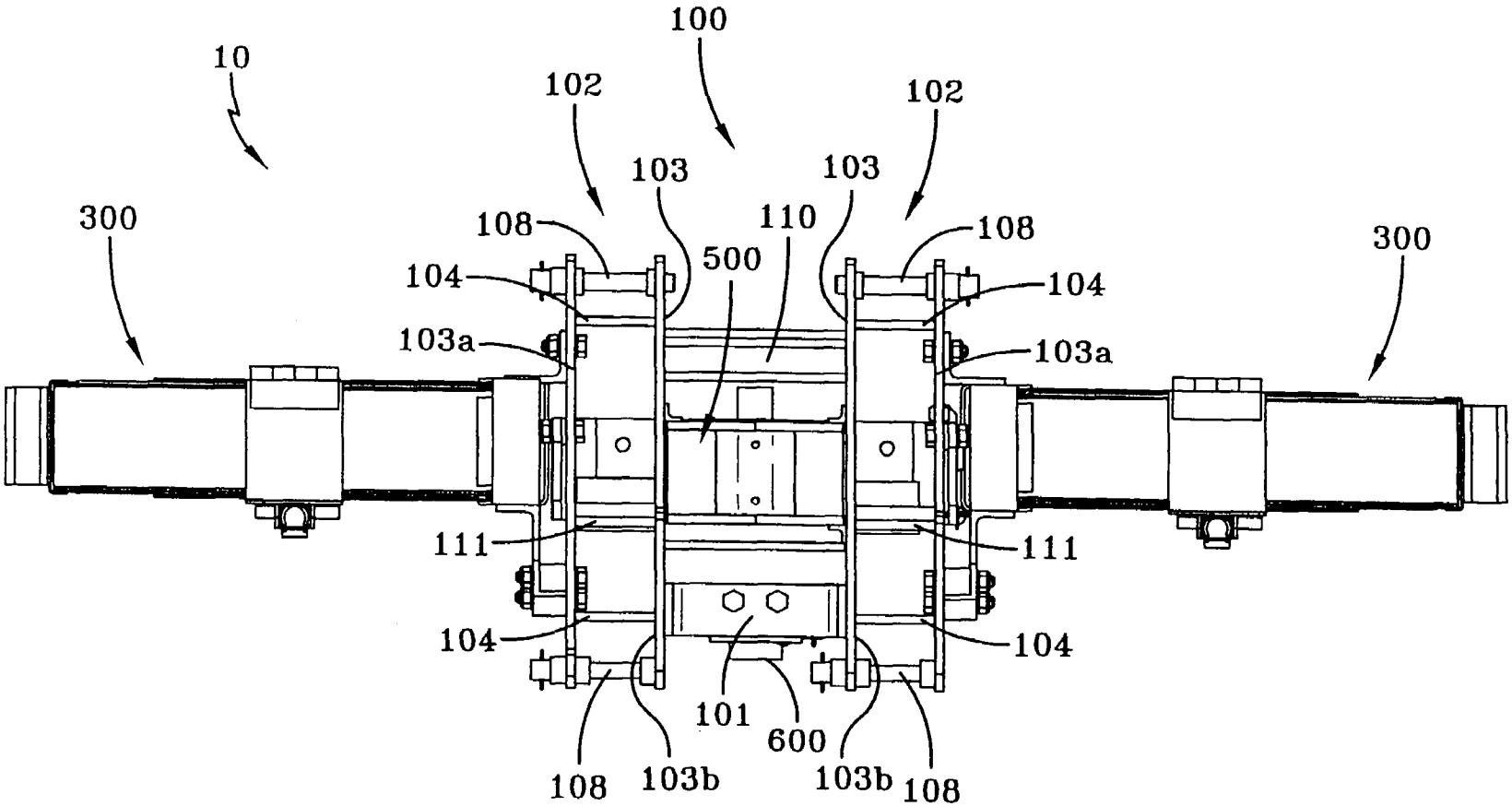
FIG. 2B is a top view of an embodiment of the gun mount.
Figure 2C:
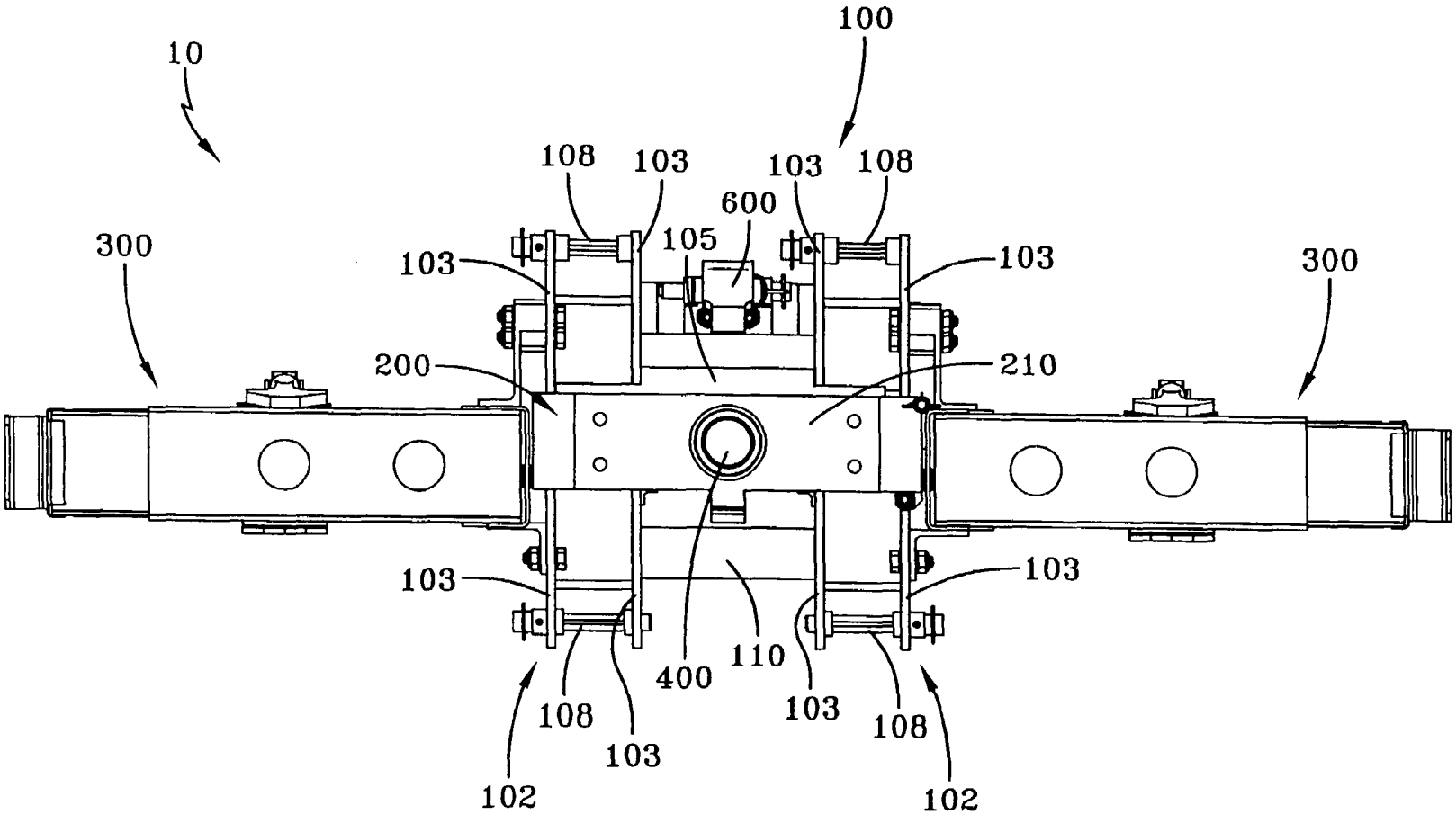
FIG. 2C is a bottom view of an embodiment of the gun mount.
Figure 3A:
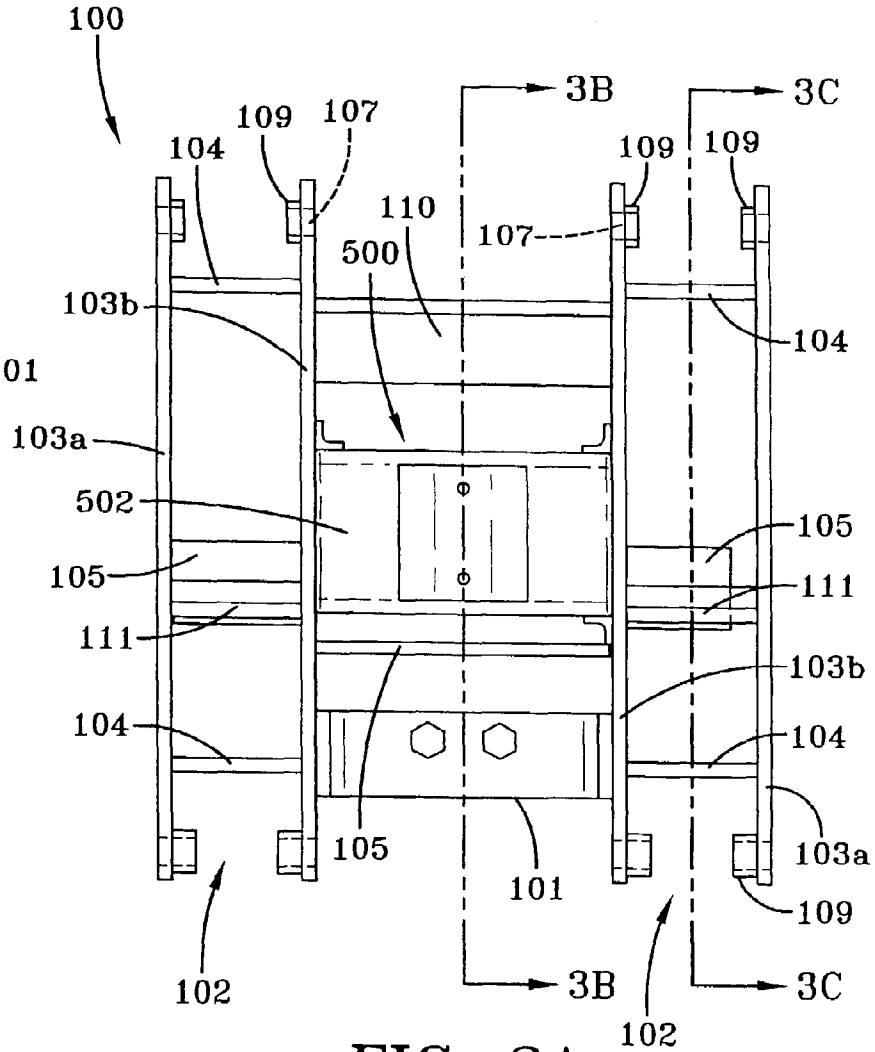
FIG. 3A is a top view of an embodiment of the cradle with an embodiment of the link deflector.
Figure 2D:
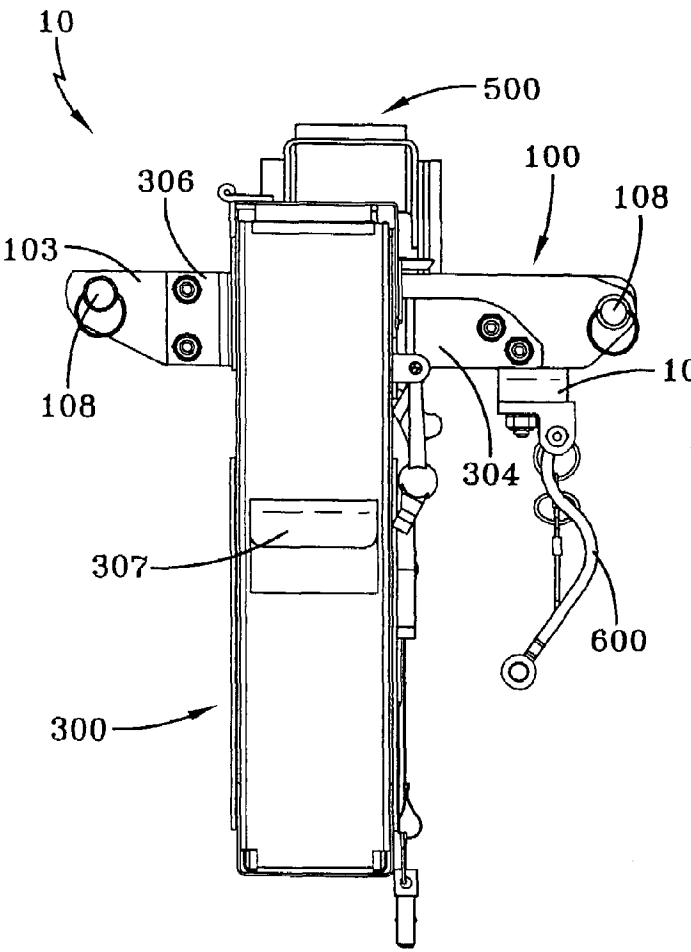
FIG. 2D is a side view of an embodiment of the gun mount.
Figure 3B:
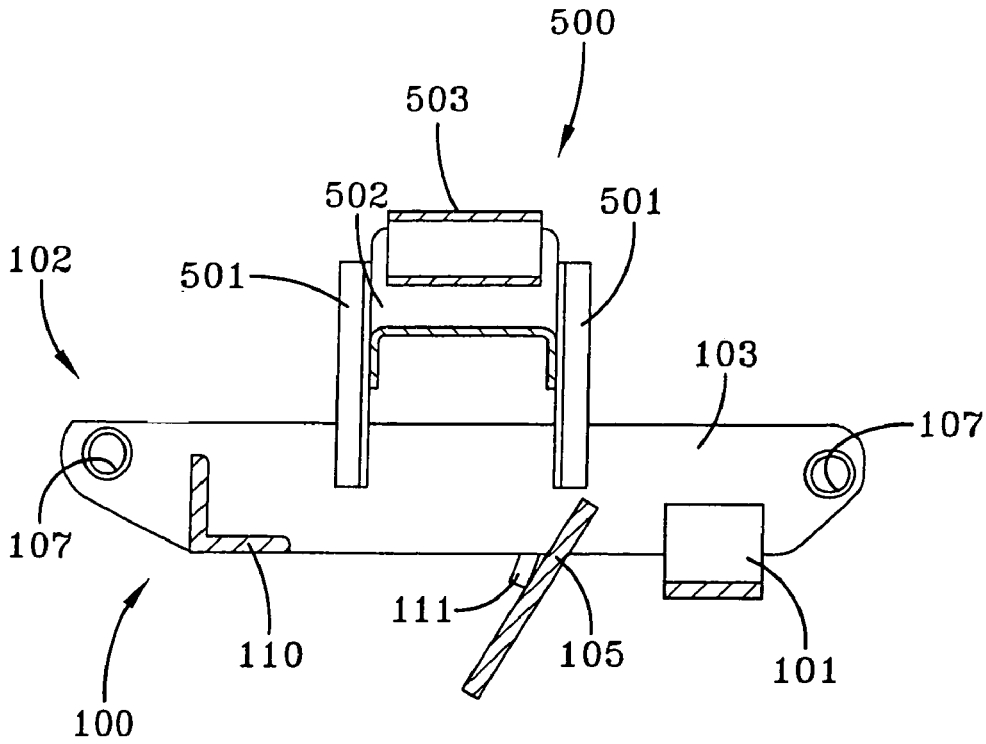
FIG. 3B is a side view taken through 3B of FIG. 3A.
Figure 3C:
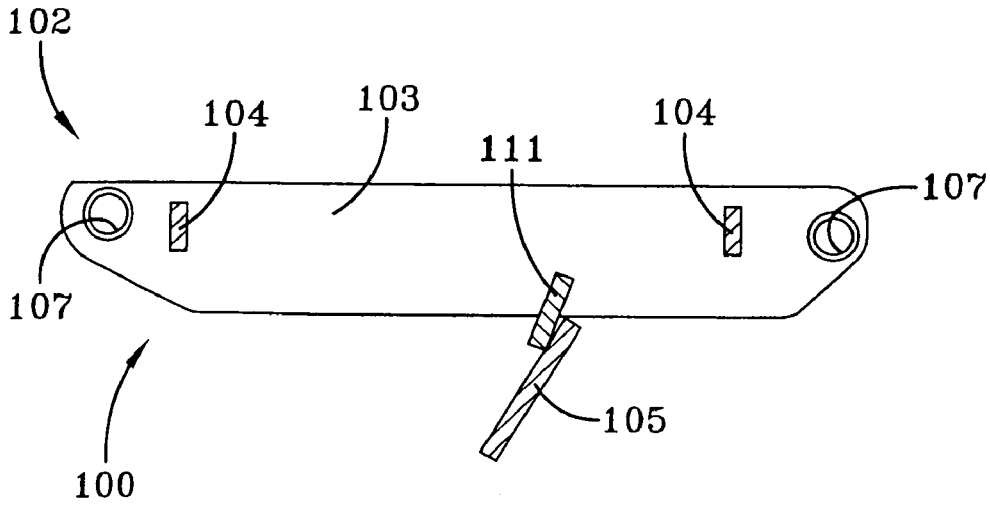
FIG. 3C is a side view taken through 3C of FIG. 3A.

The cradle 100, as shown in FIGS. 2A, 2B, 2C, 2D, 3A, 3B and 3C holds two machine guns; however, it may be configured to hold more. The cradle may include a u-portion 101 and two gun holder assemblies 102. The u-portion 101 may be disposed between the two gun holder assemblies 102. Each gun holder assembly 102 may be a configuration of plates and supports that hold and support a gun. Any type of configuration that is practicable may be used. As seen in FIGS. 2B and 3A, each gun holder assembly 102 may include two plates 103 (an outer plate 103*a* and an inner plate 103*b*, the inner plate 103*b* attached to the u-portion 101). The plates 103 may be substantially parallel. Each gun holder assembly 102 may include two spacers 104 that are each attached to both the outer plate 103*a* and the inner plate 103*b*. The spacers 104 may be substantially perpendicular to the plates 103. The gun holder assembly 102 may also include a ramp plate 111 and a deflector plate 105. The ramp plate 111 and the deflector plate 105 are small rectangular plates that function together to force ammunition links and fired casings downward and to deflect the ammunition links forward and away from the user and gun. The plates 103 may also include apertures 107 along with pin retainers 109 to accept locking pins 108. The locking pins 108 may act as a locking apparatus and secure the guns such that the guns will not dislodge when in use or in the storage position. In operation, the machine gun main body is placed between the outer plates 103*a* and inner plate 103*b* and is locked into place using the locking pins 108. In the preferred embodiment, each gun holder assembly 102 includes a forward locking pin and a rear locking pin. The forward locking pin stabilizes and locks the forward or front part of the gun, while the rear locking pin stabilizes and locks the rear or back part of the gun. In addition, the cradle 100 may include a support bar 110. The support bar 110 may be disposed between the two inner plates 103*b*, and cross sectionally attached to each inner plate 103*b*. As shown in FIG. 3B, the support bar 110 may have an L shaped cross-section. As seen in FIG. 1, a stow bar 600 may be attached to the u-portion 101 of the cradle 100. The stow bar 600 allows the guns to be stowed or held in a certain position, particularly, but without limitation, in an upward facing safety position. A stow pin 601 may be used to lock the stow bar 600 and lock the cradle 100 in place.

Figure 4C:
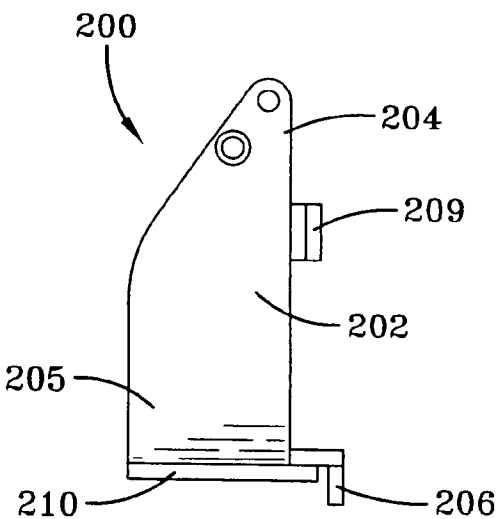
FIG. 4C is a side view of an embodiment of the carriage.

As seen in FIGS. 1, 2A, 4A, 4B and 4C, the carriage 200 may have a carriage base portion 201 and two carriage plate portions 202. The two carriage plate portions 202 extend perpendicularly from the carriage base portion 201 to substantially form a u-shape. At the points of intersection of the carriage base portion 201 and the carriage plate portions 202, the carriage 200 may have rounded corners 203. The carriage plate portions 202 may include an upper end portion 204 and a lower end portion 205. The carriage plate portions 202 are attached to the carriage base portion 201 at their respective lower end portions 205. As seen in FIG. 4C, the carriage plate portions 202 may be truncated rectangles, such that the upper end portion 204 of the carriage plate portions 202 is truncated. The corners of the truncated rectangles may be rounded. The carriage 200 may also include two inner carriage bosses 207 for stabilizing and creating a stabilizing and/or contact surface between the carriage 200 and the cradle 100, a depression stop block 209 for preventing the cradle 100 from depressing too much, and a train stop 206 for preventing the cradle 100 from going too far left or too far right. The two inner carriage bosses 207 and the depression stop block 209 may be located on the inner portion 208 of the carriage plate portions 202. The two inner carriage bosses 207 may have a substantially circular cross section and be located in the upper end portion 204 of the carriage plate portion 202. The cradle 100 pivots against the inner carriage bosses 207. The depression stop block 209 may hold a bolt that can be adjusted up or down to set the desired maximum depression limit. The train stop 206 may be located at the lower end portion 205 of the carriage 200.

The carriage 200 may also include a base plate 210. The carriage base portion 201 is attached to the base plate 210. The base plate 210 is located directly below the carriage base portion 201. Both the base plate 210 and the carriage base portion 201 are fastened to each other. The preferred method of fastening is welding; however any type of fastening method that is practicable may be used. The base plate 210 and the carriage base portion 201 may include connection apertures 211 that can accept fasteners to attach a shield assembly to the base plate 210 and the carriage base portion 201. The base plate 210 and the carriage base portion 201 may also each have pintle apertures 212 to accept the pintle 400.

Figure 5C:
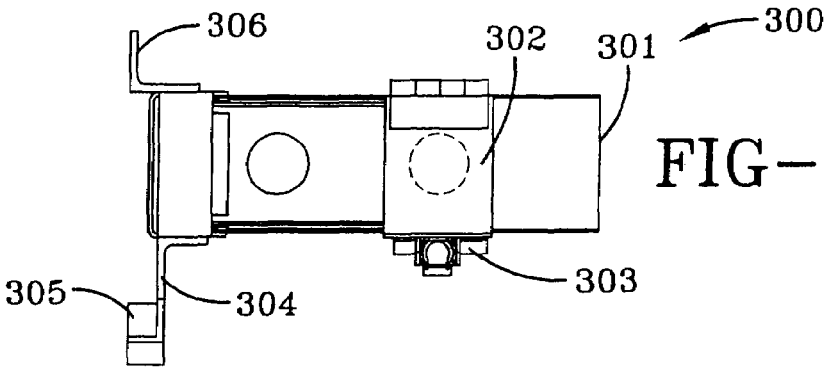
FIG. 5C is a top view of an embodiment of the ammunition tray.
Figure 5A:
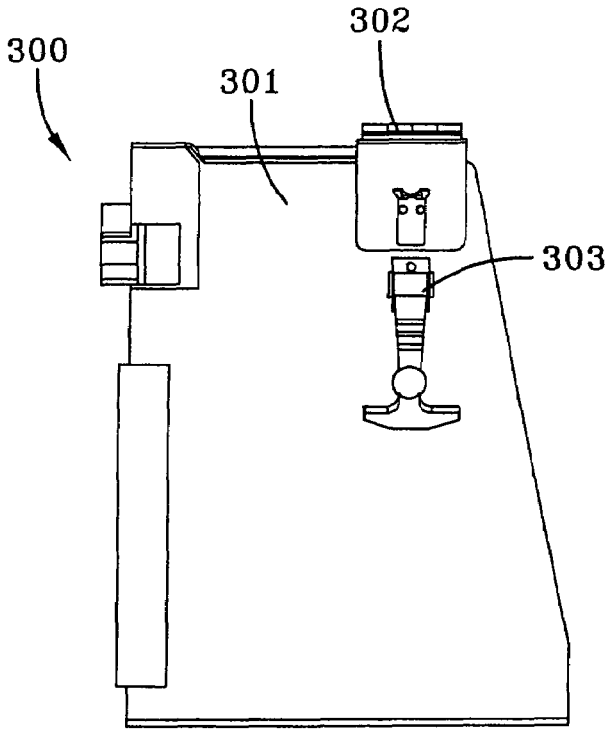
FIG. 5A is a front view of an embodiment of the ammunition tray.
Figure 5B:
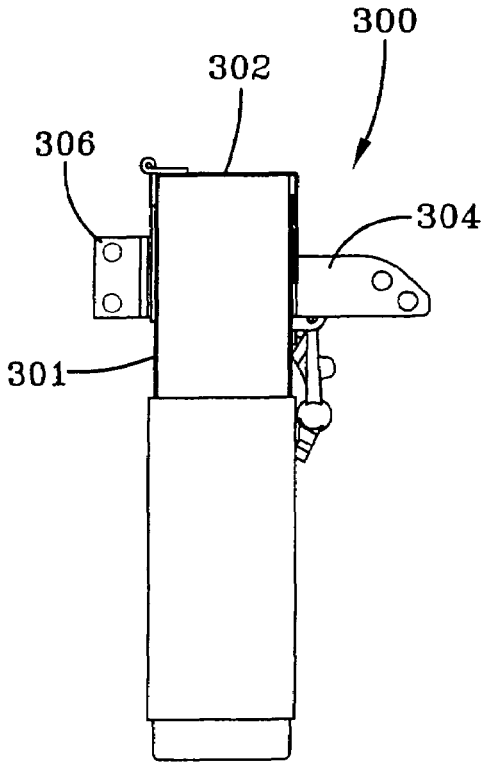
FIG. 5B is a side view of an embodiment of the ammunition tray.
Figure 5D:
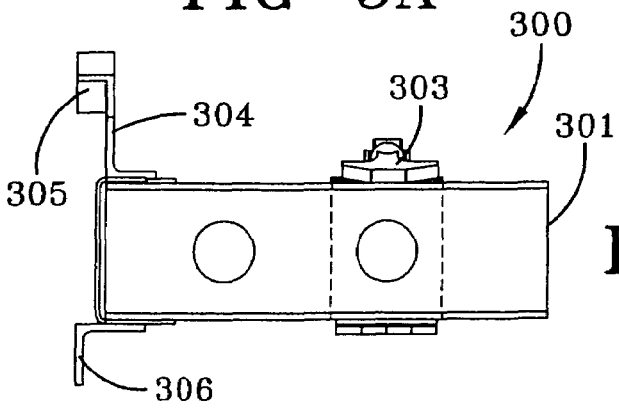
FIG. 5D is a bottom view of an embodiment of the ammunition tray.

The two ammunition trays 300 may be located on opposite sides of the carriage 200. As seen in FIGS. 5A, 5B, 5C, and 5D each ammunition tray 300 may include a tray body 301 for holding ammunition and a lid 302 for opening the tray body 301. The tray body 301 may be rectangular shaped or a slightly truncated rectangle as shown in FIG. 5A. However, the tray body 301 may be shaped any way practicable. The ammunition tray 300 may also include a latch assembly 303 for opening and closing the lid 302 of the ammunition tray 300. This may be used to refill ammunition into an ammunition can 308, which may be disposed within the tray body 301. The ammunition tray 300 may also include a bracket 304. The bracket 304 may attach the ammunition tray 300 to the one of the plates 103 of the gun holder assembly 102 (specifically the outer plate 103*a*). As seen in FIGS. 1, 5C and 5D, there may be a spacer 305 between the bracket 304 and the plate 103. Any type of fastener may be used to attach the bracket 304 to the plate 103. The ammunition tray 300 may also include a spacer bracket 306 for additional support for attachment to the plate 103 (specifically the outer plate 103*a*). The spacer bracket 306 may be disposed on the opposite side of the tray body 301 from the bracket 304. In addition, the ammunition tray 300 may also include hooks 307, disposed on the ammunition can 308.

Figure 6B:
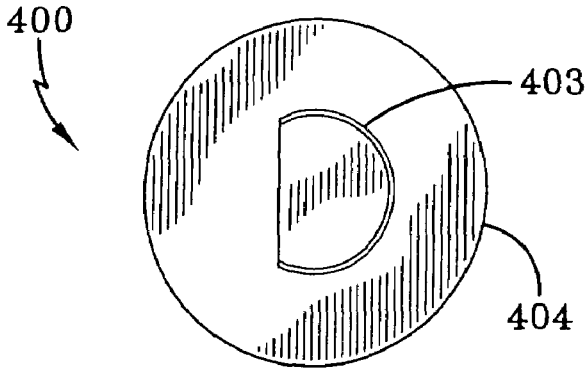
FIG. 6B is a top view of an embodiment of the pintle.
Figure 6A:
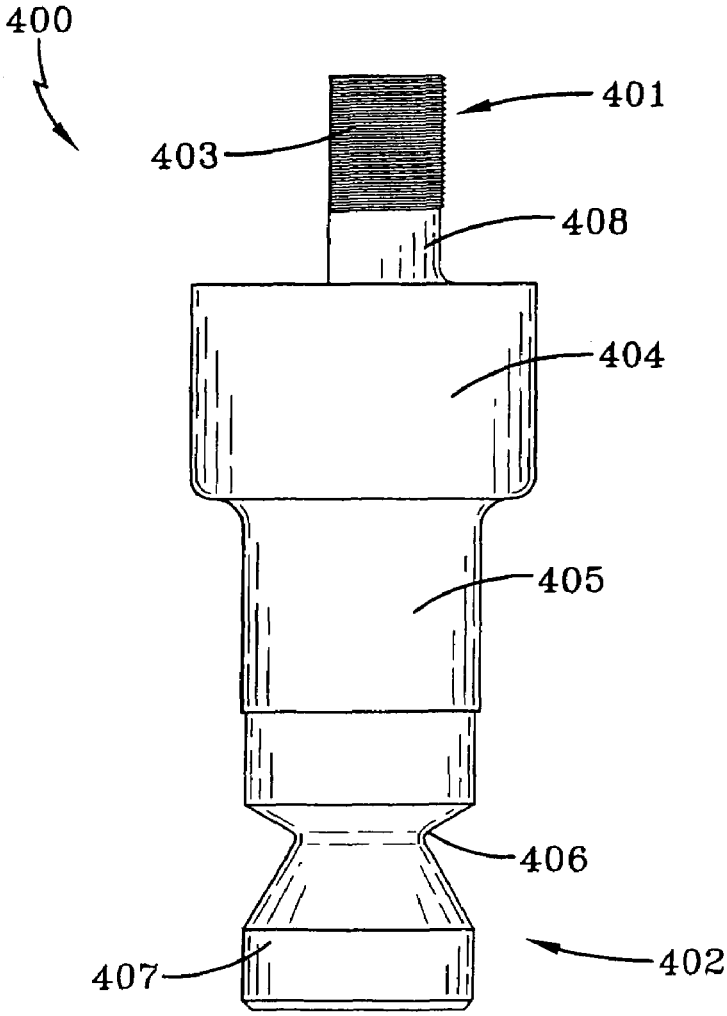
FIG. 6A is a side view of an embodiment of the pintle.

As seen in FIGS. 6A and 6B, the pintle 400 may have a first end portion 401 and a second end portion 402. The first end portion 401 of the pintle 400 may communicate and be attached to the carriage 200, specifically to the carriage base portion 201 and the base plate 210. The carriage base portion 201 and the base plate 210 may have pintle apertures 212 for accepting the first end portion 401 of the pintle 400. The pintle 400 may include a threaded portion 403, a head portion 404, a neck portion 405, an indented portion 406, and a tip portion 407. All these portions have substantially circular outer diameters and they may all be substantially axially aligned. The threaded portion 403 may be inserted into the carriage 200 and secured with a locking nut, specifically the threaded portion 403 may be inserted into the pintle apertures 212 designated for the pintle 400. The threaded portion 403 has substantially the same size cross section through its entire portion. The threaded portion 403 is in communication with the head portion 404. Right before the head portion 404, the threaded portion 403 may end and there may be a non-threaded shaft 408, which extends from the threaded portion 403 toward the head portion 404. The head portion 404 may have the largest cross section of the pintle 400, and the head portion 404 has substantially the same size cross section through its entire portion. The head portion 404 extends from the non-threaded shaft 408 and tapers down toward the neck portion 405, which extends to the indented portion 406. The indented portion 406 then tapers down (decreases in cross sectional area), then tapers back up (increases in cross sectional area) to the tip portion 407, which communicates or is attachable to a gun stand.

The link deflector 500 may be located between the two gun holder assemblies 102. The link deflector 500 is attached to the middle portion of the cradle 100 to deflect the links downward as they are pushed out of the gun while firing. The links are forced downward and deflect forward off of the deflector plate 105, away from the gunner. As seen in FIG. 3B the link deflector 500 may include link supports 501, a deflector brace 502 and a sight plate 503. The link supports 501 may attach the deflector brace 502 to the plates 103 of the gun holder assemblies 102 (specifically the inner plates 103*b*). The sight plate 503 may be disposed on top of the deflector brace 502 to allow a sight to be attached to the gun mount 10 if desired.

Figure 4B:
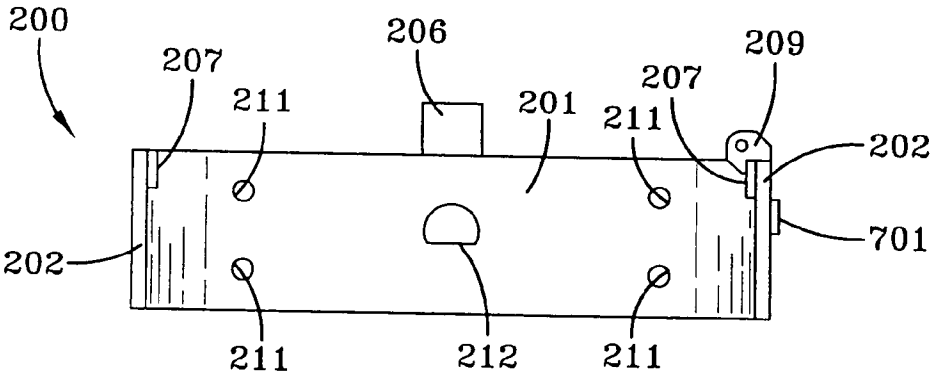
FIG. 4B is a top view of an embodiment of the carriage.
Figure 4A:
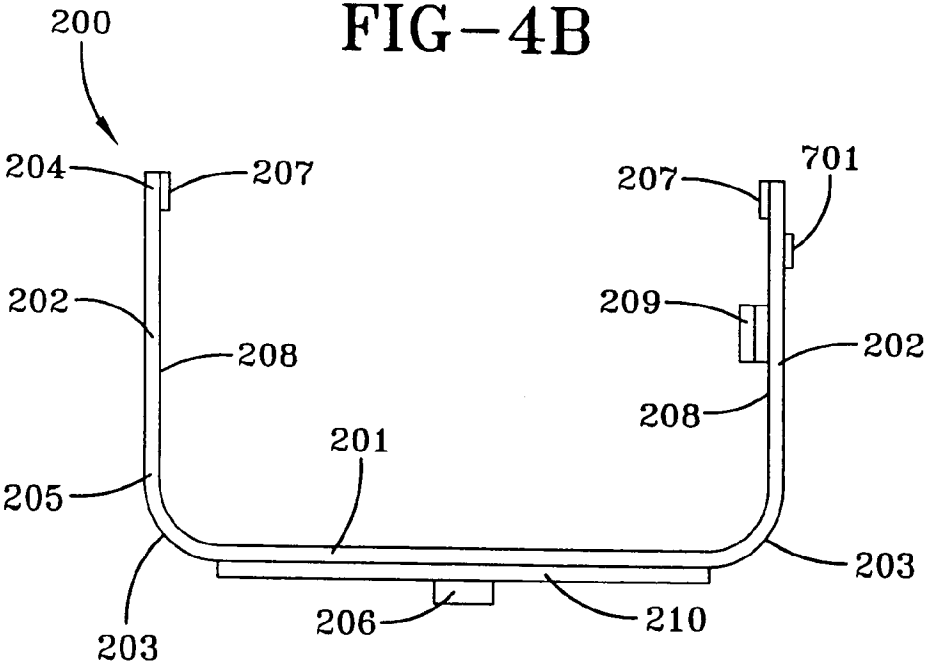
FIG. 4A is a front view of an embodiment of the carriage.

As seen in FIG. 1, the gun mount 10 may also include a pin 700 that locks the cradle 100 and the carriage 200 together and holds the gun mount 10 in the horizontal position. As seen in FIGS. 4A and 4B, the gun mount 10 may include a boss 701 that corresponds to the pin 700.

When introducing elements of the present invention or the preferred embodiment(s) thereof, the articles "a," "an," "the," and "said" are intended to mean there are one or more of the elements. The terms "comprising," "including," and "having" are intended to be inclusive and mean that there may be additional elements other than the listed elements.

Although the present invention has been described in considerable detail with reference to certain preferred versions thereof, other versions are possible. Therefore, the spirit and scope of the appended claims should not be limited to the description of the preferred versions contained herein.

What is claimed is:

1. A gun mount, comprising:

a cradle for holding two guns, the cradle includes a u-portion and two gun holder assemblies, the gun holder assemblies disposed on opposite sides of the u-portion, the gun holder assemblies for holding the guns;

a carriage for holding the cradle, the carriage attached to the cradle such that the cradle may pivot left and right, and depress and elevate;

two ammunition trays disposed on opposite sides of the carriage, the two ammunition trays able to supply ammunition to the two guns;

a pintle, the pintle attached to the carriage, the pintle attachable to a gun stand;

a link deflector for deflecting discharged ammunition links downward as the ammunitions links come out of the two guns, the link deflector attached to the cradle and disposed between the two gun holder assemblies;

a deflector plate attached to the link deflector for deflecting discharged ammunition links and fired casings away from a user, the deflector plate attached to the cradle;

a locking apparatus for securing the guns in a selected firing position;

a stow bar for securing the guns in a safe elevated position;

a depression stop block attached to the carriage with a bolt that can be adjusted up or down to set the desired maximum depression limit; and a train stop attached to the carriage for preventing the cradle from moving too far left or too far right.

* * * * *